US005884366A

United States Patent [19]

Jeong

[11] Patent Number: 5,884,366

[45] Date of Patent: Mar. 23, 1999

[54] DOOR HINGE FIXING STRUCTURE FOR REFRIGERATOR

[75] Inventor: Gwan Sik Jeong, Changwon, Rep. of Korea

[73] Assignee: LG Electronics Inc., Rep. of Korea

[21] Appl. No.: 7,281

[22] Filed: Jan. 14, 1998

[30] Foreign Application Priority Data

Aug. 30, 1997 [KR] Rep. of Korea ..... 1997 24115

[51] Int. Cl.[6] ..... E05D 7/12

[52] U.S. Cl. ..... 16/271; 16/266; 16/268; 16/382; 49/388; 312/326; 312/405

[58] Field of Search ..... 16/271, 268, 266, 16/382, 254, 258; 248/284.1; 49/381, 397, 388; 312/326, 329, 290, 405, 401

[56] References Cited

FOREIGN PATENT DOCUMENTS 398963 9/1933 United Kingdom .

1301503 12/1972 United Kingdom .

9010775 9/1990 WIPO .

*Primary Examiner*—Chuck Y. Mah

*Attorney, Agent, or Firm*—Ostrolenk, Faber, Gerb & Soffen, LLP

[57] ABSTRACT

A door hinge fixing structure for a refrigerator which is capable of enabling an easier assembling and disassembling operation between a refrigerator main body and a refrigerator door without using a predetermined device (tool) for assembling or disassembling the same. The structure includes a hinge support member fixed to a predetermined portion of a refrigerator main body and having a plurality of engaging plates each having a curved portion and an engaging shoulder protrudely formed on a center portion thereof on which the engaging plate is formed, and an upper hinge being detachable with respect to the hinge support member and having a first engaging groove formed in the center portion thereof and a plurality of second engaging grooves formed above and below the first engaging groove into which the engaging plate of the hinge support member is inserted.

5 Claims, 9 Drawing Sheets

DOOR HINGE FIXING STRUCTURE FOR REFRIGERATOR

BACKGROUND OF THE INVENTION

1. Field of the Invention

The present invention relates to a door hinge fixing structure for a refrigerator, and in particular to an improved door hinge fixing structure for a refrigerator which is capable of enabling an easier assembling and disassembling operation between a refrigerator main body and a refrigerator door without using a predetermined device (tool) for assembling or disassembling the same.

2. Description of the Background Art

As shown in FIG. 1, in the conventional refrigerator, a freezing chamber door 1*a* and a refrigerating chamber door 1*b* of a door 1 are engaged with a main boding 2 by a top mounting method using a door hinge structure which is mounted on an upper and lower portions of the refrigerator, respectively.

In addition, when fabricating the refrigerator, the door 1 and the main body 2 are individually fabricated, and then the same are assembled. At this time, the door 1 is rotatably engaged with the main body 2 using a door hinge 3.

Recently, a large size refrigerator attracts big attentions from the consumer. Therefore, the side-by-side type two-door refrigerator, in which two doors 4 are opened and closed with respect to the hinged portions of the main body, is widely used.

Hereinafter, the above-described side-by-side type two-door refrigerator is called a two-door type refrigerator.

The door hinge structure of the two-door type refrigerator will be explained with reference to FIGS. 3 and 4.

First, a pin 5*a* is protrudely formed on an upper surface of a 90° curved lower hinge 5 and is inserted into a pin insertion hole 4*b* formed in a lower surface of the door 4, and an engaging hole 5*b*, into which a bolt 8 of a lower hinge engaging hole 6*a* formed in a lower portion of the main body 6 is inserted, is formed in a vertical portion of the lower hinge 5.

In addition, a pin 9*a*, which is inserted into a pin insertion hole 4*b* formed in one side of an upper portion of the door 4, is protrudely formed in an upper hinge 9 having a portion curved at a predetermined angle, and a plurality of engaging holes 9*b* are formed in another side of the door 4, so that the main body 6 and the upper hinge 9 are engaged using the bolts 8 inserted into the upper hinge engaging holes 6*b* and the engaging holes 9*b*.

The assembling procedure of the thusly constituted two-door type refrigerator will now be explained with reference to the accompanying drawings.

The engaging holes 5*b* formed in the lower hinge 5 and the lower hinge engaging holes 6*a* formed in the main body 6 are aligned and engaged using an engaging member such as a bolt 8, thus fixing the lower hinge 5 to the refrigerator main body 6.

The pin 5*a* formed on the upper surface of the lower hinge 5 fixed to the lower portion of the main body 6 is inserted into the pin insertion hole 4*b*, so that the lower portion of the door 4 is assembled to the lower hinge 5.

The pin 9*a* formed in a lower surface of the upper hinge 9 is inserted into the pin insertion hole 4*a* formed on the surface of the door 4, and the engaging hole 9*b* formed in another end portion of the upper hinge 9 and the hinge engaging hole 6*b* formed on the upper surface of the refrigerator main body 6 are aligned.

The engaging holes 9*b* of the upper hinge 9 and the engaging holes 6*b* of the main body 6 are engaged using the bolts 8, so that the upper hinge 9 is fixed to the refrigerator main body 5, and the door 4 is engaged with the refrigerator main body 6, thus finishing the assembling procedure.

When disassembling the refrigerator door 4 from the refrigerator main body 6, the above-described procedures are reversely proceeded.

Since the two-type refrigerator is bulky and heavy, when moving the same, the door is disassembled from the main body. At the installation site, the door is assembled to the main body.

However, in the above-described door hinge structure for the conventional two-door type refrigerator, since the doors and the refrigerator are engaged using the engaging member, a predetermined device (tool) is needed for assembling or disassembling the same, so that the fabrication process is complicated, and thus much time is required, and the fabrication cost is increased.

SUMMARY OF THE INVENTION

Accordingly, it is an object of the present invention to provide a door hinge fixing structure for a refrigerator which overcomes the aforementioned problems encountered in the background art.

It is another object of the present invention to provide a door hinge fixing structure for a refrigerator which is capable of enabling an easier assembling and disassembling operation between a refrigerator main body and a refrigerator door without using a predetermined device (tool) for assembling or disassembling the same.

To achieve the above objects, there is provided a door hinge fixing structure for a refrigerator which includes a hinge support member fixed to a predetermined portion of a refrigerator main body and having a plurality of engaging plates each having a curved portion and an engaging shoulder protrudely formed on a center portion thereof on which the engaging plate is formed, and an upper hinge being detachable with respect to the hinge support member and having a first engaging groove formed in the center portion thereof and a plurality of second engaging grooves formed above and below the first engaging groove into which the engaging plate of the hinge support member is inserted.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
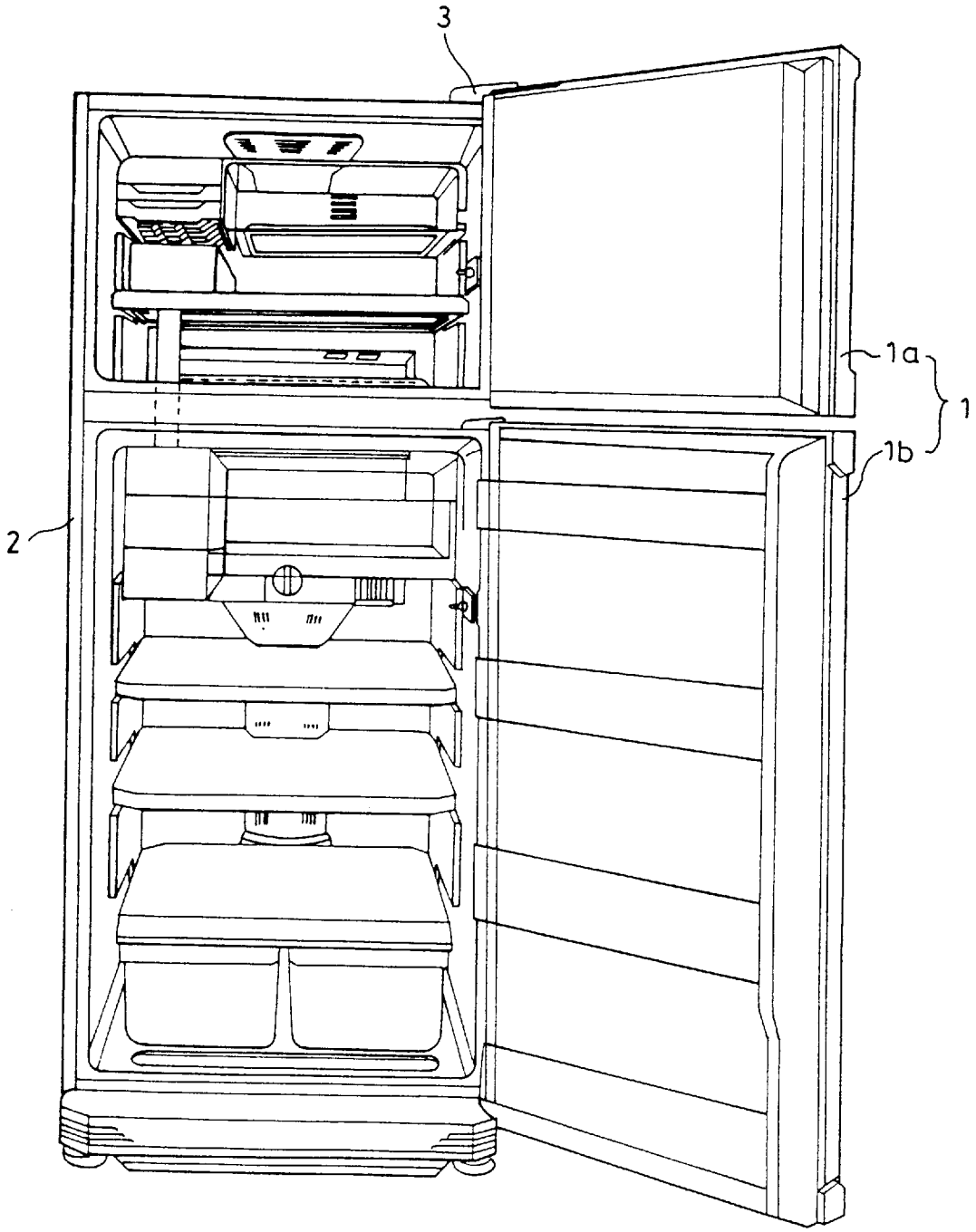
FIG. 1 CONVENTIONAL ART
FIG. 1 is a front view illustrating a state that a door of a conventional refrigerator is opened.
Figure 2:
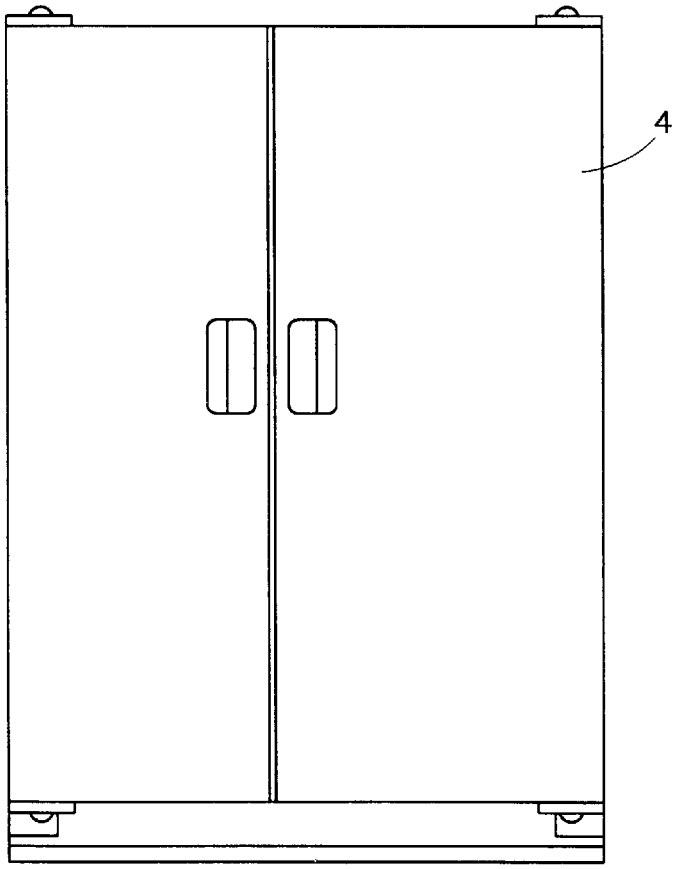
FIG.2 CONVENTIONAL ART
FIG. 2 is a front view illustrating a conventional side-by-side type two-door refrigerator.
Figure 3:
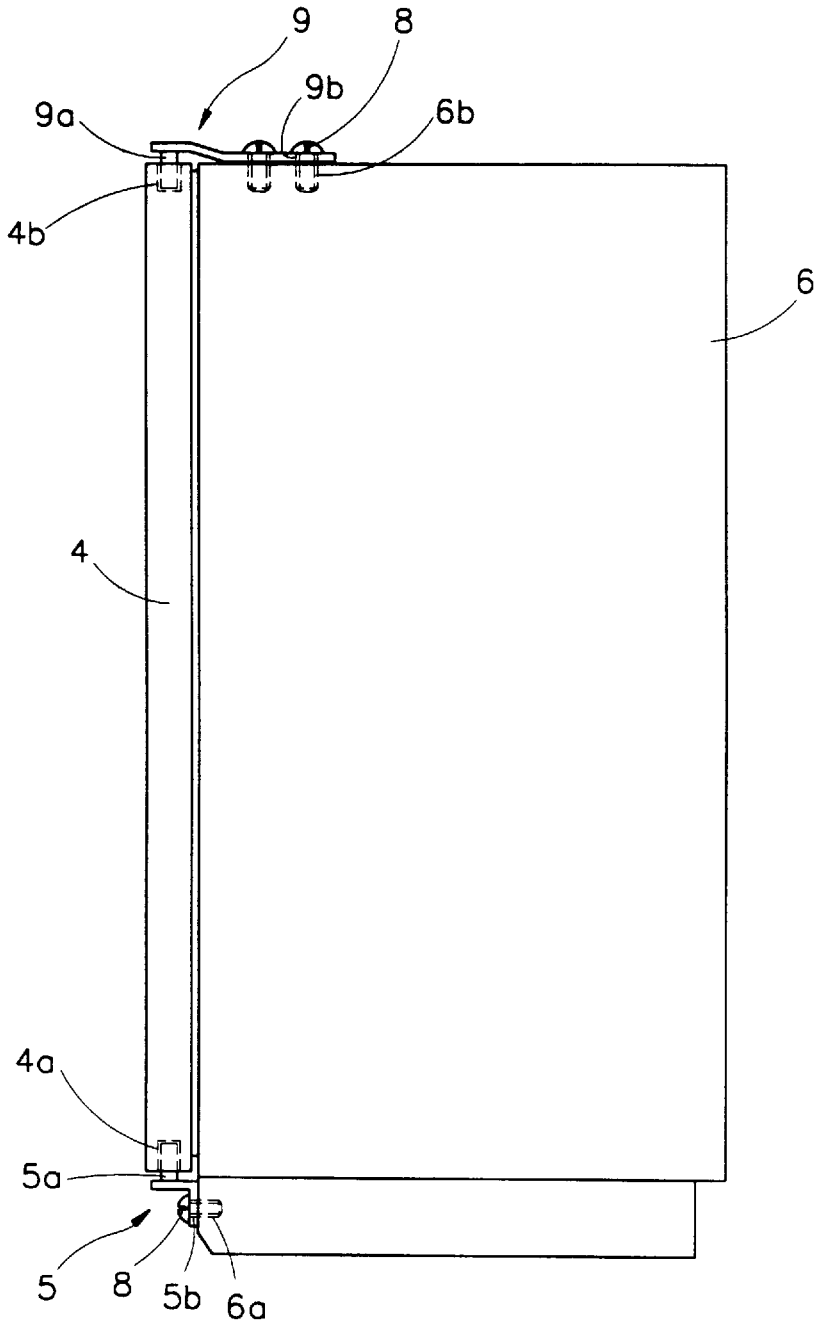
FIG.3 CONVENTIONAL ART
FIG. 3 is a side view illustrating the refrigerator of FIG. 1.
Figure 4:
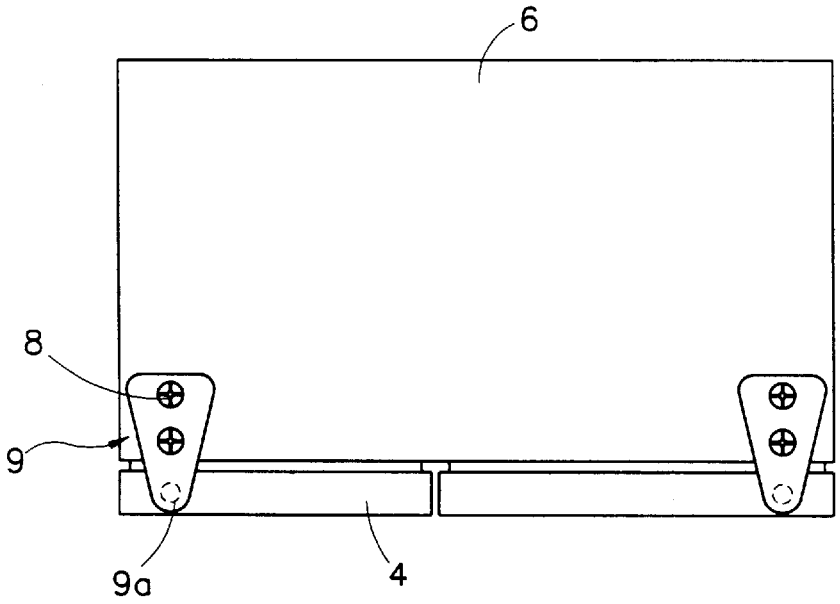
FIG. 4 CONVENTIONAL ART
FIG. 4 is a plan view illustrating the refrigerator of FIG. 1.
Figure 5A:
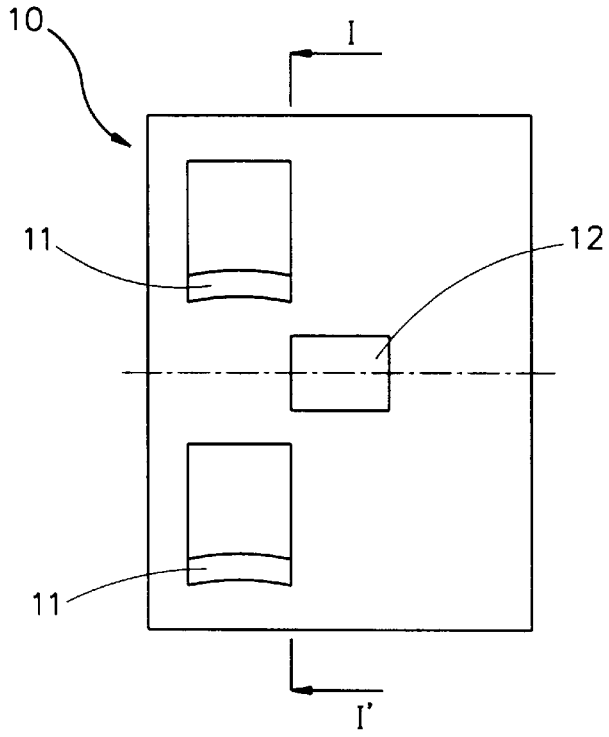
FIG. 5A is a plan view illustrating a hinge support member of a door hinge structure according to the present invention.
Figure 5B:
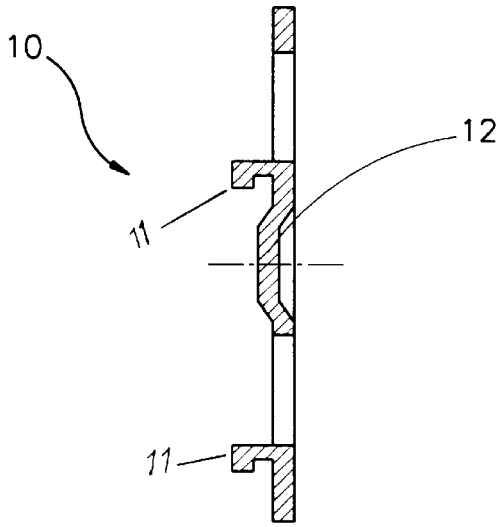
FIG. 5B is a cross-sectional view taken along line I–I' of FIG. 5A.
Figure 6A:
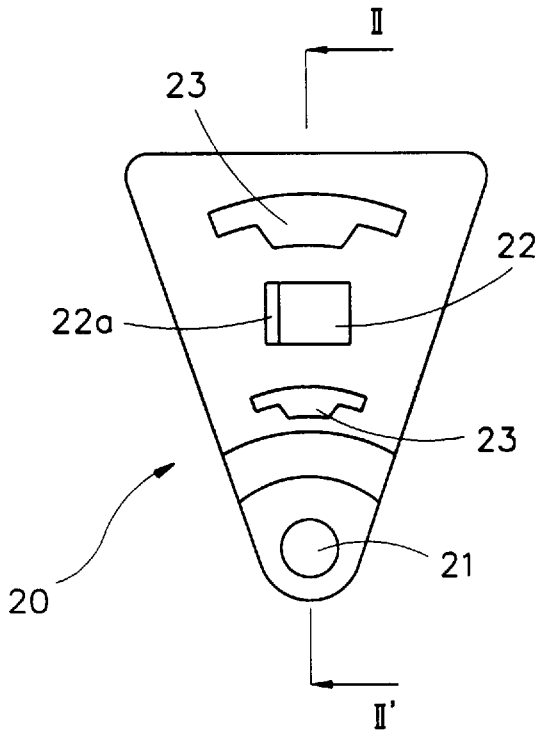
FIG. 6A is a plan view illustrating an upper hinge of a door hinge structure according to the present invention.
Figure 6B:
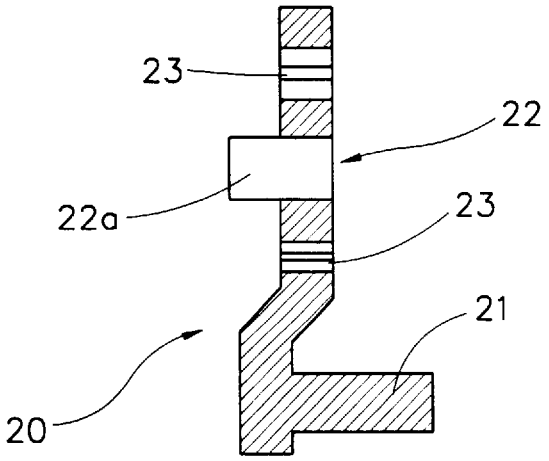
FIG. 6B is a cross-sectional view taken along line II–II' of FIG. 5A.
Figure 7:
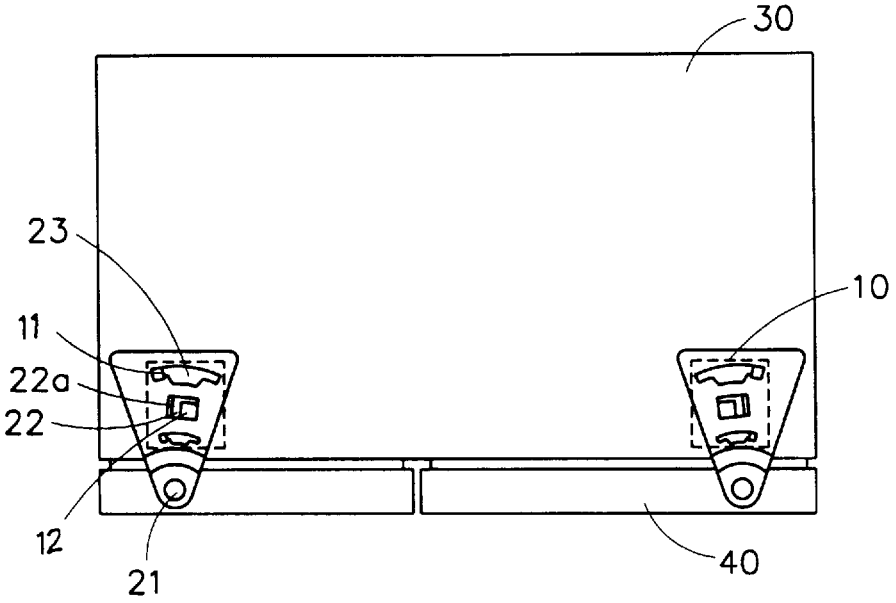
FIG. 7 is a plan view illustrating a refrigerator having a door hinge according to the present invention.
Figure 8:
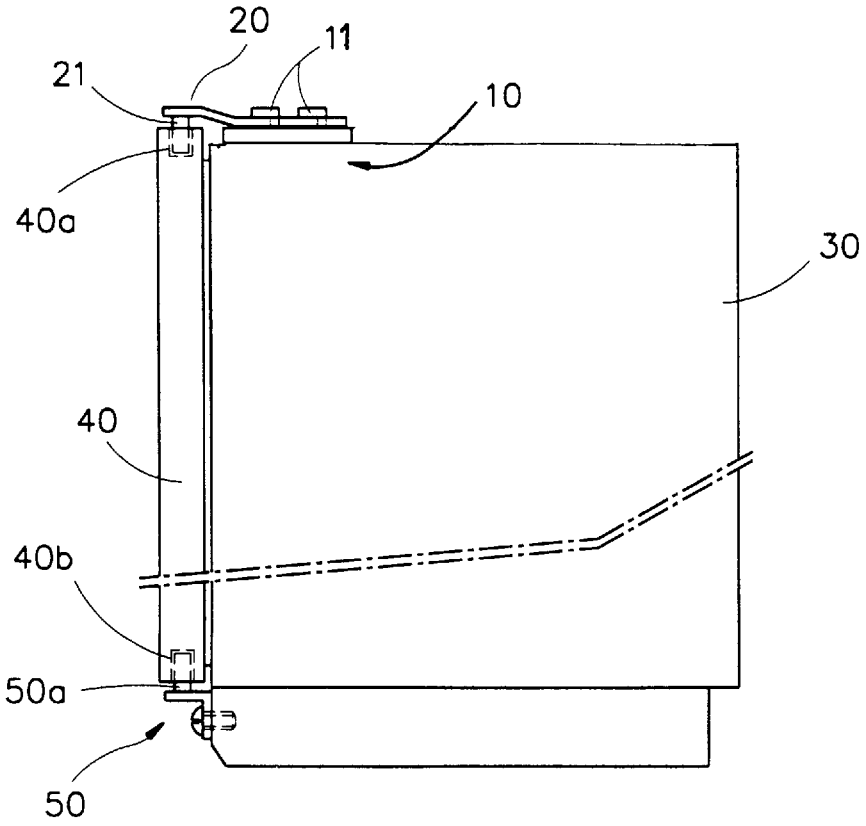
FIG. 8 is a side view illustrating a refrigerator having a door hinge according to the present invention.

The door hinge structure for a refrigerator according to the present invention will now be explained with reference to the accompanying drawings.

As shown in FIGS. 5A and 5B and 6A and 6B, the door hinge structure according to the present invention includes a hinge support member 10 and an upper hinge 20.

The hinge support member 10 is square-shaped and has a pair of engaging plates 11 each having a 90° curved portion 11*a*, and an engaging shoulder 12 is protrudely formed in a center portion of an upper surface on which the engaging plates 11 are formed.

In addition, an engaging groove 22, into which the engaging shoulder 12 of the hinge support member 10 is inserted, passe through the center portion of the upper hinge 20, and a handle 22*a* is protrudely formed in one side of the engaging groove 22.

An arch-shaped engaging groove 23 is formed above and below the engaging groove 22, respectively, so that the engaging plates 11 of the hinge support member 10 are inserted thereinto.

The assembling procedure of the refrigerator main body and door using the above-described door hinge structure will now be explained with reference to FIGS. 7 and 8 and FIGS. 9A and 9B.

First, since the assembling procedure that the lower hinge 50 is engaged with a refrigerator main body 30 and the door 40 is the same as the conventional art, the description thereof will be omitted.

The hinge support member 10 is fixed to an upper end portion of the refrigerator main body 30 by using an adhesive or a welding method.

A pin 21 formed in the lower surface of the upper hinge 20 is inserted into the pin insertion hole 40*a* formed on the upper surface of the door 40 the lower portion of which is engaged.

The engaging plates 11 of the hinge support member 10 fixed to the refrigerator main body 30 are inserted into a wider portion of the engaging grooves 23 formed in the upper hinge 20 engaged with the door 40.

At this time, the engaging plates 11 of the hinge support member 10 are not fully engaged with the engaging groove 23 of the upper hinge 20, and the lower surface of the upper hinge 20 is placed on the engaging shoulder 12 of the hinge support member 10, and the upper hinge 20 does not closely contact with the hinge support member 10.

Figure 9A:
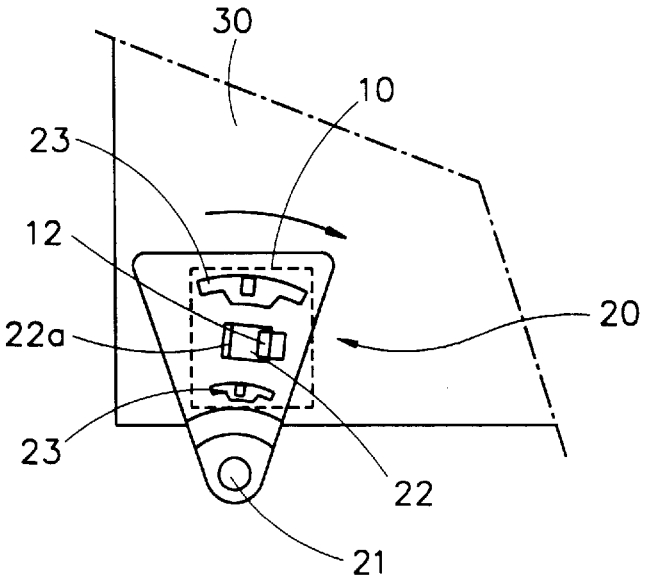
FIG. 9A is a plan view illustrating an initial engaging state between an upper hinge and a hinge support member according to the present invention.
Figure 9B:
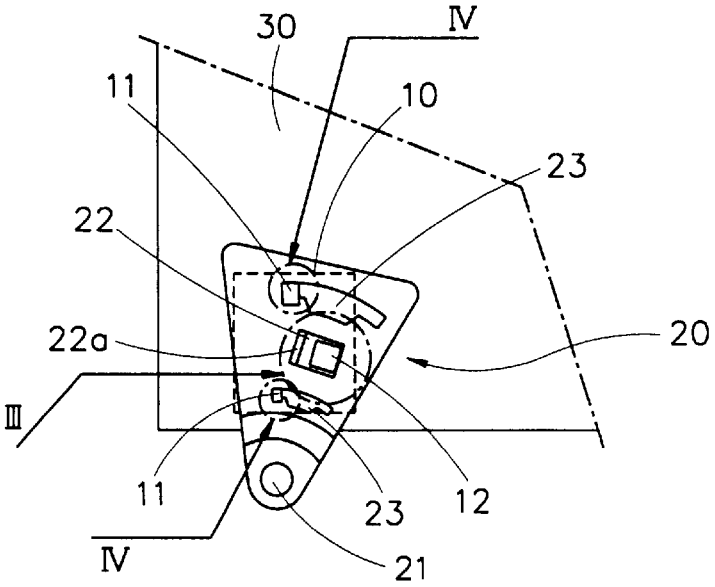
FIG. 9B is a plan view illustrating a state that an upper hinge and a hinge support member are engaged according to the present invention.

A user rotates the handle 22*a* formed in the engaging groove 22 of the upper hinge 20 in the clockwise direction with respect to the pin 21 of the upper hinge 20 as shown in FIG. 9A. Thereafter, in the upper hinge 20, as shown in FIG. 9B, the engaging shoulder 13 of the upper hinge 20 is inserted into the engaging groove 22 formed in the center portion of the upper hinge 20.

Figure 10:
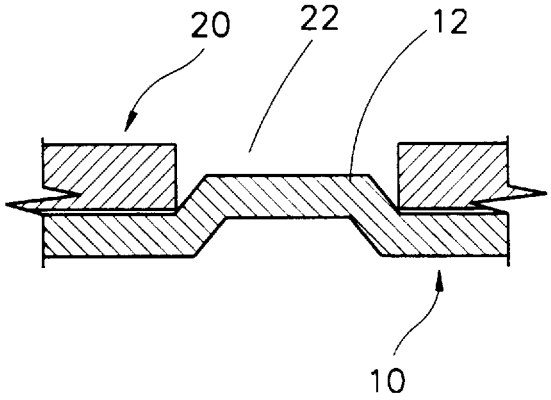
FIG. 10 is an enlarged view of the portion III of FIG. 9B.

At this time, as shown in FIG. 10, in the upper hinge 20, the lower surface of the upper hinge 20 closely contacts with the upper surface of the hinge support member 10, so that the both sides of the engaging shoulder 12 of the hinge support member 10 protruded in the engaging groove 23 contact with the inner surfaces of the engaging groove 23, thus preventing movements of the upper hinge 20.

In addition, the engaging plates 11 of the hinge support member 10 move from the wider portion to the narrower portion along the engaging groove 23 of the upper hinge 20 and then is engaged and fixed.

Figure 11:
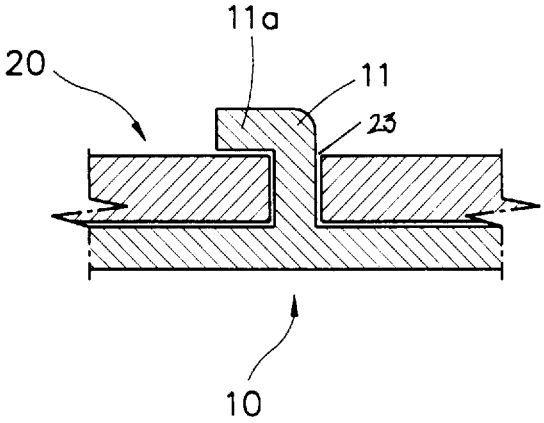
FIG. 11 is an enlarged view of the portion IV of FIG. 9B.

At this time, as shown in FIG. 11, in the engaging plates 11 of the hinge support member 10, the curved portions 11*a* of the engaging plates 11 formed in the hinge support member 10 are engaged by the upper hinge 20, thus preventing movements of the upper hinge 20, and in addition the upper hinge 20 is not escaped from the hinge support member 10, so that the upper hinge 20 is fixed to the refrigerator main body 30 of the refrigerator.

The upper hinge 20 is fixed to the refrigerator main body 30 and at the same time the door 40 is engaged with the same. Therefore, the door 40 is rotatable with respect to the refrigerator main body 30 with respect to the pin 21 of the upper hinge 20.

The disassembling procedure of the door hinge structure for a refrigerator according to the present invention will now be explained.

First, the user holds the handle 22*a* formed in one side of the engaging groove 22 and upwardly lifts the same up to a predetermined height so that the engaging shoulder 12 of the hinge support member 10 is fully escaped from the engaging groove 22 of the upper hinge 20, and thus the upper hinge 20 becomes movable.

Thereafter, the user holds the handle 22*a* formed in one side of the engaging groove 22 and rotates the upper hinge 20 in the counterclockwise direction until the engaging plates 11 of the hinge support member 10 are moved from the narrower portion to the wider portion of the engaging groove 22 of the upper hinge 20.

In the above-described state, the upper hinge 20 is lifted upwardly, so that the engaging plates 11 are escaped, and the upper hinge 20 is disassembled from the refrigerator main body 30.

At the same time, the pin 21 formed in one end portion of the upper hinge 20 is separated from the pin insertion hole 40*a* of the door 40, so that the upper portion of the door 40 is easily separated from the refrigerator main body 30.

After the upper portion of the door 40 is separated from the refrigerator main body 30, the door 40 is upwardly lifted for separating the door 40 from the pin 50*a* of the lower hinge 50 inserted into the pin insertion hole 40*b* formed in the lower surface of the door 40, thus finally separating the door 40 from the refrigerator main body 30.

So far, only the hinge structure for one door among two doors of the refrigerator was explained. Since the hinge structure for the other door of the refrigerator is the same as the above-described hinge structure, the description thereof will be omitted, and the assembling and disassembling procedures of the hinge structure with respect to the other door of the refrigerator will be also omitted.

As described above, in the door hinge structure for a refrigerator according to the present invention, it is possible to assemble and disassemble the refrigerator main body and the doors without using a predetermined device (tool), so that an easier assembling and disassembling procedure is implemented when moving the refrigerator, thus saving the installation time.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A door hinge structure for a refrigerator, comprising:

a hinge support member fixed to a predetermined portion of a refrigerator main body and having a plurality of engaging plates each having a curved portion and an engaging shoulder protrudely formed on a center portion thereof on which the engaging plate is formed; and an upper hinge being detachable with respect to the hinge support member and having a first engaging groove formed in the center portion thereof and a plurality of second engaging grooves formed above and below the first engaging groove into which the engaging plate of the hinge support member is inserted.

2. The structure of claim 1, wherein said first engaging groove of the upper hinge includes a handle formed in one side thereof.

3. The structure of claim 1, wherein said second engaging groove is arched-shaped and has a wider portion in its center portion and narrower portions in its side portions.

4. The structure of claim 1, wherein said hinge support member is square-shaped.

5. The structure of claim 1, wherein said upper hinge is triangle-shaped.

* * * * *